United States Patent [19]

Nishibori

[11] Patent Number: 4,506,876

[45] Date of Patent: Mar. 26, 1985

[54] SHEET PAPER ATTRACTING SYSTEM

[75] Inventor: Toshiki Nishibori, Nara, Japan

[73] Assignee: Sharp Kabushiki Kaisha, Osaka, Japan

[21] Appl. No.: 464,378

[22] Filed: Feb. 7, 1983

[30] Foreign Application Priority Data

Feb. 13, 1982 [JP] Japan ..... 57-21570

[51] Int. Cl.[3] ..... B65H 3/34

[52] U.S. Cl. ..... 271/104; 271/167; 271/263

[58] Field of Search ..... 271/104, 96, 106, 107, 271/121, 167, 110, 111, 262, 263

[56] References Cited

U.S. PATENT DOCUMENTS

| | | | |
|---|---|---|---|
| 1,691,606 | 11/1928 | Hitchcock | 271/262 |
| 1,773,266 | 8/1930 | Hallstream | 271/262 |
| 3,025,052 | 3/1962 | Gutteling | 271/104 X |
| 3,126,201 | 3/1964 | Rehm | 271/104 |
| 3,260,520 | 7/1966 | Sugden | 271/104 X |
| 4,269,405 | 5/1981 | Mitzel | 271/106 X |
| 4,345,752 | 8/1982 | Nakamura | 271/104 X |

*Primary Examiner*—Richard A. Schacher

*Attorney, Agent, or Firm*—Birch, Stewart, Kolasch & Birch

[57] ABSTRACT

A paper sheet supplying system including a paper sheet attracting unit for attracting a paper sheet for feeding purposes, and a piled sheet feeding prevention unit which confronts the paper sheet attracting unit at a preselected position. When more than one sheet is attracted by the paper sheet attracting unit, the piled sheet feeding preventing unit removes the paper sheet or sheets from the sheet attracted by the paper sheet attracting unit so that only one sheet is accurately fed.

10 Claims, 7 Drawing Figures

SHEET PAPER ATTRACTING SYSTEM

BACKGROUND OF THE INVENTION

The present invention relates to a sheet paper attracting system for use in a sheet paper feeding system of a copying machine, a facsimile system, a printing machine, etc.

The present invention relates, more particularly, to a piled feeding preventing system in a sheet paper feeding system.

Various types of sheet paper feeding systems have been developed for supplying a paper sheet from a storing section wherein a plurality of sheets are stacked. In such a system it must be ensured that one sheet of paper is transferred at a desired time. It is not desirable that the transferred paper includes more than one sheet piled up.

To prevent piled feeding, one of the conventional systems includes a catch for separating the paper sheets at one corner thereof. This mechanism does not work well when the attracting force between the sheets is considerably strong. Furthermore, the catch may damage the surface of the paper sheet. Another conventional system includes a separating roller which rotates in the reverse direction. This type of system does not work well when the frictional condition of the separating roller varies during a long usage time. Furthermore, an accurate adjustment is required depending on the thickness of the paper sheet. Moreover, it is clear that the separating roller may damage the surface of the paper sheet.

Accordingly, an object of the present invention is to provide a novel paper feeding system which prevents the piled feeding of the paper sheets.

Another object of the present invention is to provide a paper sheet attracting system which ensures an accurate feeding without damaging the surface of the paper sheeet.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a paper sheet attracting system is provided for attracting a paper sheet through the use of a suction air force. A piled feeding preventing system is provided in a manner that the piled feeding preventing system confronts the paper sheet attracting system when the paper sheet attracting system attracts the paper sheet. The piled feeding preventing system functions to attract the paper sheet attracted by the paper sheet attracting system through the use of a section air force.

In a preferred form, the attracting force created by the piled feeding preventing system is selected lower than the attracting force created by the paper sheet attracting system, and the attracting force created by the piled feeding preventing system is selected greater than the attracting force formed between the adjacent two paper sheets.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
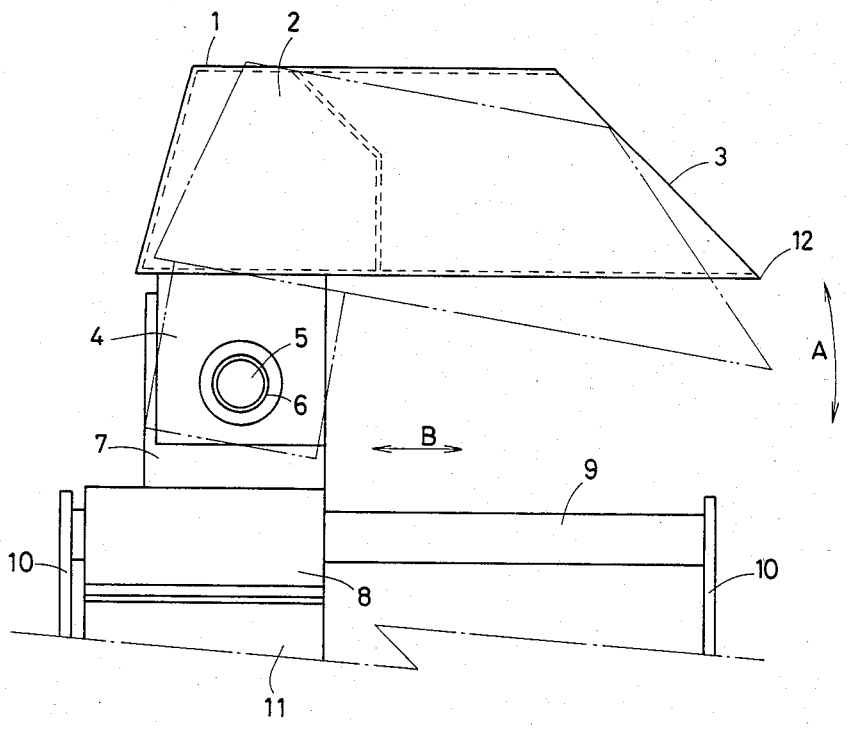
FIG. 1 is a schematic side view of an embodiment of a piled sheet feeding preventing system of the present invention.

The piled sheet feeding preventing system of the present invention is constructed to cooperate with a sheet paper attracting system such as disclosed in my copending application, SHEET PAPER ATTRACTING SYSTEM, U.S. application Ser. No. 464,377 which claims priority based on Japanese patent application No. 57-20467 which was filed in Japan on Feb. 10, 1982.

The piled sheet feeding preventing system of the present invention includes a suction air casing 1 having a pressure chamber 2 formed therein. Air intake openings 3 are formed at desired sections in the suction air casing 1. A rotating shaft supporting plate 4 is secured to the bottom surface of the suction air casing 1, and a rotating shaft 5 is fixed to the rotating shaft supporting plate 4. The rotating shaft 5 is rotatably supported by a bearing member 6 which is provided on a drive table 7. Accordingly, the suction air casing 1 is rotatable about the rotating shaft 5 as shown by an arrow A in FIG. 1. Stopper members (not shown) are provided for determining the rotating angle of the suction air casing 1 about the rotating shaft 5.

The above-mentioned unit is slidably (in the direction shown by an arrow B) mounted on a slide shaft 9. More specifically, a slider 8 is secured to the drive table 7. The slider 8 is mounted on the slide shaft 9 which is secured to a slide shaft supporting plate 10. A motor 11 is secured to the drive table 7 via a motor securing plate 14 for driving the unit including the suction air casing 1.

The above-mentioned rotating operation of the suction air casing 1 is controlled by an ON/OFF operation of a solenoid 16. The solenoid 16 is secured to a solenoid supporting plate 17 and is connected, via a latch 19, to a latch angle 18 which is fixed to the bottom surface of the suction air casing 1. The above-mentioned sliding operation is driven by the motor 11 via gears 15 supported by a gear supporting plate 13. The suction air casing 1 is communicated with a suction blower (not shown) through a duct 20.

Figure 2:
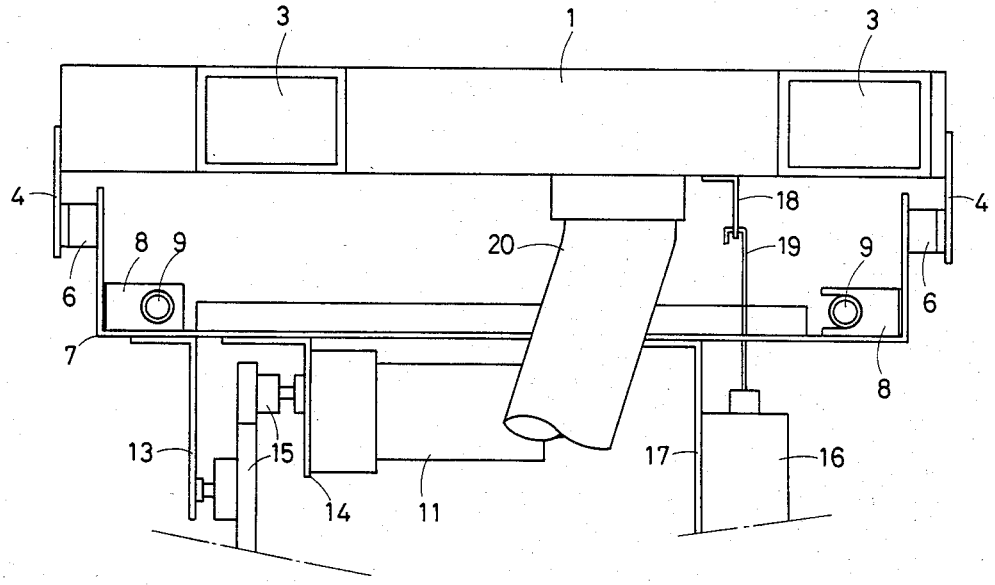
FIG. 2 is a schematic front view of the piled sheet feeding preventing system of FIG. 1.

An operational mode of the piled sheet feeding preventing system of FIGS. 1 and 2 will be described with reference to FIGS. 3, 4, 5 and 6.

As already discussed above, the piled sheet feeding preventing system of the present invention cooperates with a paper sheet attracting system 21. An example of the paper sheet attracting system is disclosed in my copending application, "SHEET PAPER ATTRACTING SYSTEM" which claims the priority from a Japanese patent application No. 57-20467 (Our Reference 2010-US,GER-T).

Figure 3:
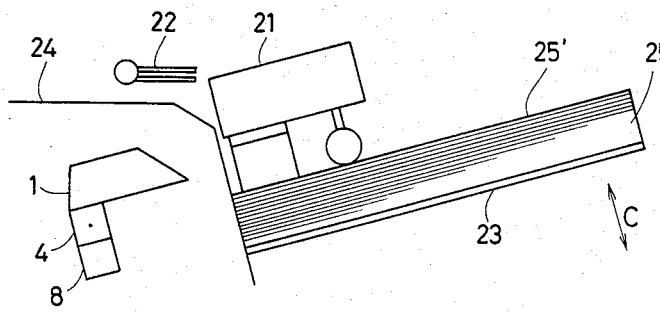
FIGS. 3, 4, 5 and 6 are schematic side view of a paper feeding system including the piled sheet feeding preventing system of FIG. 1 for explaining an operational mode of the piled sheet feeding preventing system of FIG. 1.

When a paper sheet feed initiation is instructed, a paper sheet supporting table 23 is driven to shift upward in the direction shown by an arrow C in FIG. 3 so that an uppermost sheet 25' in paper sheets 25 stacked on the paper sheet supporting table 23 contacts the paper sheet attracting system 21. At this moment, the piled sheet feeding preventing system is held at a stand-by position and the suction operation is not performed by the piled sheet feeding preventing system.

Figure 4:
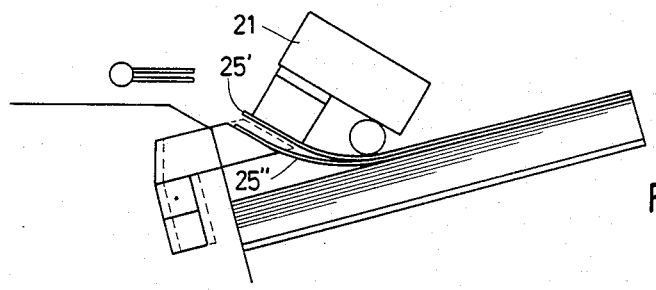
Figure 7:
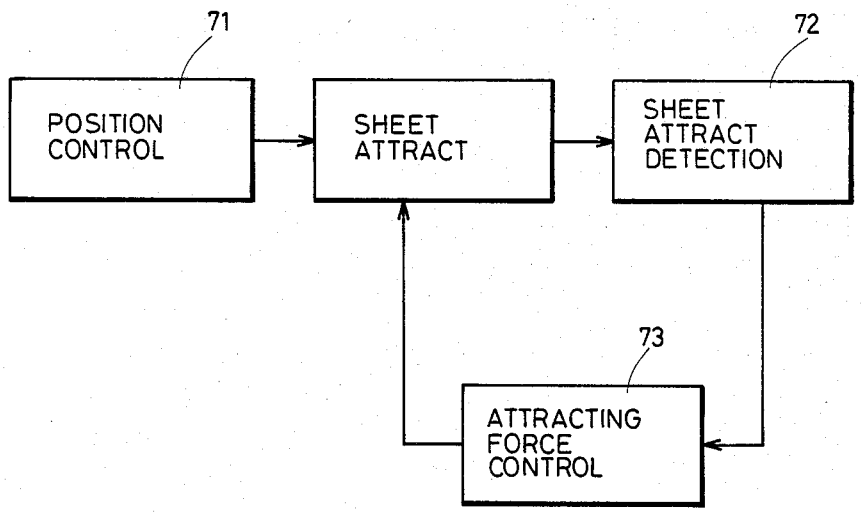
FIG. 7 is a schematic block diagram of a control system for activating the piled sheet feeding preventing system of FIG. 1.

Then, the suction operation of the paper sheet attracting system 21 is initiated to attract the uppermost sheet 25'. The paper sheet attracting system 21 is rotated as shown in FIG. 4. At this moment, the suction operation of the piled sheet feeding preventing system is initiated, and the piled sheet feeding preventing system is moved to a position near the rear surface of the uppermost sheet 25'. Thereafter, the piled sheet feeding preventing system is driven backward to a preselected position as shown by the solid line in FIG. 4. The forward and backward movement of the piled sheet feeding preventing system is controlled by a position control circuit 71 shown in FIG. 7. When the piled sheet feeding preventing system is held as shown by the solid line in FIG. 4, a determination is carried out as to whether any sheets are attracted by the piled sheet feeding preventing system. This determination is conducted by a sheet attract detection circuit 72 through the use of a detection of the variation of the load current of the suction blower.

The attracting force created by the piled sheet feeding preventing system is selected slightly lower than that of the paper sheet attracting system 21. Therefore, the uppermost sheet 25' caught by the paper sheet attracting system 21 will not be separated from the paper sheet attracting system 21. If the paper sheet is not attracted by the piled sheet feeding preventing system, only one sheet (the uppermost sheet 25') has been correctly attracted by the paper sheet attracting system 21. At this moment, the piled sheet feeding preventing system is rotated to depress the following sheets as shown in FIG. 6.

When more than one sheet has been attracted by the paper system attracting system 21, the next sheet (sheets) 25'' is attracted by the piled sheet feeding preventing system as shown in FIG. 4. That is, the attracting force of the piled sheet feeding preventing system is selected greater than the attracting force created between adjacent two sheets. When the sheet attract detection circuit 72 detects that the piled sheet feeding preventing system attracts one or more sheets, the suction operation is interrupted, and the piled sheet feeding preventing system is returned to the initial stand-by position as shown by the dotted line in FIG. 5, thereby allowing the sheets to return to the paper sheet supporting table 23. After a predetermined time has passed, the above-mentioned operation is repeated to again attract the piled sheets 25'' if any.

When the sheet attract detection circuit 72 does not develop a signal indicating that the paper sheet is not attracted by the piled sheet feeding preventing system, because the paper sheet attracted by the piled sheet feeding preventing system is again attracted by the uppermost sheet 25', even when the above-mentioned operation is repeated by several times, an attracting force control circuit 73 is enabled to increase the attracting force created by the piled sheet feeding preventing system. When the next sheets 25'' can not be removed at all, the system operation is interrupted and an alarm device is enabled.

Figure 5:
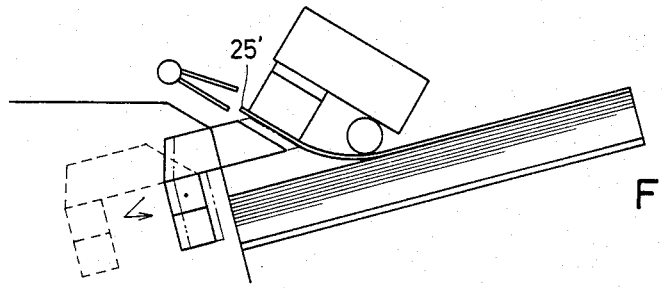
Figure 6:
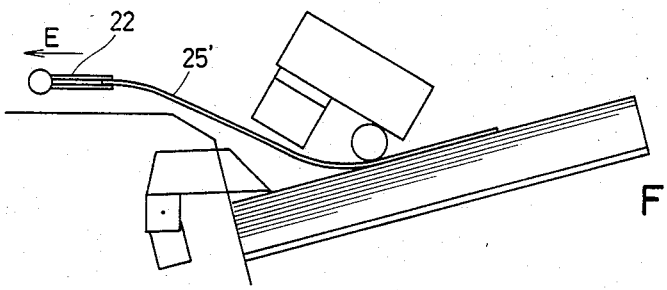

With the above-mentioned operation, when only the uppermost sheet 25' is attracted by the paper sheet attracting system 21, a sheet feeding mechanism 22 is enabled as shown in FIGS. 5 and 6 to transfer the uppermost sheet 25' along a guide 24 in the direction shown by an arrow E. While the sheet feeding operation is conducted, the piled sheet feeding preventing system depresses the paper sheets 25 stacked on the paper sheet supporting table 23. When the sheet feeding operation is completed, the piled sheet feeding preventing system is returned to the initial stand-by position as shown in FIG. 3.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A paper sheet supplying system wherein individual sheets of paper are sequentially removed from a stack of sheets which comprises a paper sheet attracting unit including a suction air casing for separating a paper sheet from the top of a stack of sheets, a piled sheet feeding preventing means containing a suction air casing for attracting a single paper sheet, location control means for locating said piled sheet feeding preventing means at a position confronting said paper sheet attracting unit at any desired time, detection means for detecting whether more than one sheet is separated from the stack of sheets by the paper attracting unit, whereby said additional sheet or sheets are separated from the top sheet, and means for returning the additional sheet or sheets which have been separated from the top sheet back to the stack of sheets.

2. The paper sheet supplying system of claim 1, wherein said location control means is enabled when said paper sheet attracting unit is positioned at a preselected position during the paper sheet attracting operation.

3. The paper sheet supplying system of claim 1, wherein the attracting force of said piled sheet feeding preventing unit is selected to be smaller than the attracting force of said paper sheet attracting unit.

4. The paper sheet supplying system of claim 3, wherein said attracting force of said piled sheet feeding preventing unit is selected to be greater than the attracting force created between adjacent two paper sheets.

5. The paper sheet supplying system of claim 4 wherein the detection means includes a sheet attract detection circuit for measuring the variation of the load current of the suction blower of the piled sheet feeding preventing system which increases when any sheets are attracted by said sheet feeding preventing system.

6. The paper sheet supplying system of claim 5 wherein the means for returning the additional sheet or sheets to the stack of sheets includes means for interrupting the suction operation of the piled sheet feeding preventing means and returning the piled sheet feeding preventing system to its initial position whereby the sheets are permitted to return to the stack of papers.

7. The paper sheet supplying system of claim 6 wherein the means for returning the additional sheet or sheets to the stack of sheets further includes means for rotating the feeding preventing system to depress the separated sheets against the stack of papers.

8. The paper sheet supplying system of claim 1 wherein means are provided for repeating the operation of the piled sheet feeding preventing means for separating said additional sheet or sheets from the top sheet.

9. The paper sheet supplying system of claim 8 wherein said repeating means includes means for increasing the vacuum of the sheet feeding preventing means.

10. The paper sheet supplying system of claim 1 further including a sheet feeding means for transferring the separated sheet away from the paper sheet supply system.

* * * * *